US007131363B2

(12) United States Patent
Tseng

(10) Patent No.: US 7,131,363 B2
(45) Date of Patent: Nov. 7, 2006

(54) PAPER-CUTTING APPARATUS AND PAPER-HOLDING DEVICE OF THE SAME

(75) Inventor: Tzu-Feng Tseng, Taipei (TW)

(73) Assignee: Primax Electronics Ltd., Taipei (TW)

( * ) Notice: Subject to any disclaimer, the term of this patent is extended or adjusted under 35 U.S.C. 154(b) by 189 days.

(21) Appl. No.: 10/841,168

(22) Filed: May 7, 2004

(65) Prior Publication Data

US 2004/0226426 A1 Nov. 18, 2004

(30) Foreign Application Priority Data

May 13, 2003 (TW) ..... 92113002 A

(51) Int. Cl.
*B26D 7/02* (2006.01)
*B25B 1/08* (2006.01)

(52) U.S. Cl. ..... 83/386; 83/455; 83/614; 269/235

(58) Field of Classification Search ..... 83/385, 83/386, 454, 455, 614; 269/86, 89, 138, 269/216, 217, 229, 235, 236
See application file for complete search history.

(56) References Cited

U.S. PATENT DOCUMENTS 2,790,498 A * 4/1957 Carscallen ..... 83/383
3,077,805 A * 2/1963 Stanley ..... 83/384
3,301,117 A * 1/1967 Spaulding ..... 83/455
4,299,377 A * 11/1981 Lenz ..... 269/136
4,702,512 A * 10/1987 Nocera ..... 269/77
5,069,097 A * 12/1991 Mori ..... 83/56
5,287,783 A 2/1994 Mori
5,664,473 A * 9/1997 Huang ..... 83/620
6,035,755 A * 3/2000 Mori ..... 83/485
6,065,383 A * 5/2000 Takaishi et al. ..... 83/368
2004/0194603 A1* 10/2004 Tseng ..... 83/651

* cited by examiner

*Primary Examiner*—Charles Goodman

(57) ABSTRACT

A cutting apparatus is provided for cutting a sheet material. The cutting apparatus includes a bed for resting thereon the sheet material, a hollow rail structure spaced from the bed, a cutting element moved along the hollow rail structure to travel on the sheet material and cut it in a desired manner, a holding plate coupled to the hollow rail structure for depressing the sheet material on the bed to facilitate the cutting operation of the cutting element, and a sustaining element disposed in the hollow rail structure. The sustaining element sustains against an upper inner surface of the hollow rail structure to lift up the holding plate and sustains against a lower inner surface of the hollow rail structure to put down the holding plate.

22 Claims, 6 Drawing Sheets

PAPER-CUTTING APPARATUS AND PAPER-HOLDING DEVICE OF THE SAME

FIELD OF THE INVENTION

The present invention relates to a sheet-processing apparatus such as a paper cutter and a holding device for securing the sheet material to be processed, e.g. the paper to be cut.

BACKGROUND OF THE INVENTION

Paper cutter is a common tool for cutting one or more pieces of paper into specified sizes efficiently. A conventional paper cutter has a rail with one fixed end pivotally secured onto the bed and one free end. A slider carrying a cutting blade can slide along the rail. While using such paper cutter, the rail is lifted up by exerting a force on the free end with the fixed end as a fulcrum. Then, the paper to be cut is placed under the rail, lying on the bed. By putting the rail down and exerting a depressing force on the rail, the paper holding plate mounted to the rail urges the paper against the bed. When the cutting blade is carried by the slider to travel on the paper clamped between the paper holding plate and the bed, the paper is cut into pieces. Since the paper is secured between the paper holding plate and the bed by way of user's depressing force, it is laboring and hard to assure of well positioning of the paper. The problem is more serious when a pile of paper is simultaneously cut. The pile of paper to be cut may not be well aligned, and in practice, the topmost sheet may slightly deviate from the others when the rail is put down to rest on the topmost sheet of paper. Hence, it is difficult to cut the paper into desired sizes accurately.

For solving this problem, an improved paper cutter is proposed by Mori in U.S. Pat. No. 5,287,783. As illustrated in FIGS. 1(*a*) and 1(*b*), the schematic diagrams show the appearance and the inner structure of this paper cutter. The paper cutter mainly comprises a bed 10, a rail 11, and a slider 12. The rail 11 is supported by two supporters 132 at two ends thereof and movably coupled to the bed 10 via the supporters 132. Below the rail 11, there is positioned a paper holding plate 131 for urging the paper to be cut against the bed 10 so as to facilitate the cutting operation. The motion of the paper holding plate 131 is controlled by a link structure 133 mounted onto one of the supporters 132. The link structure 133 includes a movable member 1331, a link 1332 and pins P1, P2, P3. For lifting up the rail 11, the movable member 1331 is turned on the pin P1 by the user, as indicated at 1331'. Hence, the pin P3 connected to the movable member 1331 moves along an arc locus L around the pin P1, as indicated at P3'. The link 1332 connected to the pin P3 will bring the pin P2 to the position of P2'. Therefore, the rail 11 led by the pin P2 is lifted up, as indicated at 11'. When the rail 11 is thus lifted up, the paper holding plate 131 also moves upwards since the paper holding plate 131 is coupled to the rail 11. After the pile of paper is put under the paper holding plate 131, the movable member 1331 is turned back to have the paper holding plate 131 move downwards to hold the paper on the bed 10. Since the paper holding plate 131 moves downwards to press the paper with the downward movement of the rail 11, slightly horizontal shift of the paper holding plate 131 is substantially conducted due to the slantingly movement of the link 1332 rather than exactly vertical movement relative to the paper. Accordingly, the topmost sheets of paper may be pushed away from the pile of paper due to the horizontal shift of the paper holding plate 131. Moreover, the link structure is too complicated to be assembled simply and conveniently so as to be disadvantageous to the assembling time and production cost.

SUMMARY OF THE INVENTION

Therefore, the present invention provides a cutting apparatus having a simplified and improved holding structure capable of pressing the paper to be cut tightly while avoiding the undesired shift of the paper.

According to the present invention, a cutting apparatus comprises a bed for resting thereon a sheet material; a hollow rail structure disposed above and spaced from the bed; a cutting element moved along the hollow rail structure to travel on the sheet material resting on the bed so as to cut the sheet material in a desired manner; a holding plate coupled to the hollow rail structure for pressing against the sheet material resting on the bed so as to facilitate the cutting operation of the cutting element; and a sustaining element disposed in the hollow rail structure for sustaining against a lower inner surface of the hollow rail structure so as to push down the holding plate to depress the sheet material in response to a first operation working thereon.

Preferably, the sustaining element further sustains against an upper inner surface of the hollow rail structure so as to lift up the holding plate to release the sheet material in response to a second operation working thereon.

Preferably, the hollow rail structure has a through hole for penetrating therethrough the sustaining element, and the upper and lower inner surfaces are walls of the through hole.

Preferably, the cutting apparatus further comprises a supporter structure secured onto the bed and coupled to the sustaining element in a manner allowing the hollow rail structure to be spaced from the bed.

In an embodiment, the sustaining element includes an eccentric cam having a shaft coupled to the supporter structure.

Preferably, the cutting apparatus further comprises a handle pivotally coupled to the supporter structure and securely connected to the shaft of the eccentric cam. The handle is pivoted to rotate the shaft in a first direction so as to drive the eccentric cam to sustain against the upper inner surface of the hollow rail structure, and pivoted to rotate the shaft in a second direction so as to drive the eccentric cam to sustain against the lower inner surface of the hollow rail structure.

In an embodiment, the eccentric cam has a circle circumference with a flat edge arranged at a position distant from the shaft for sustaining against the lower inner surface of the hollow rail structure in response to the first operation working on the shaft.

Preferably, the shaft of the eccentric cam has a polygonal cross section, e.g. a hexagonal cross section.

Preferably, the cutting apparatus further comprises an elastic member interfacing between the hollow rail structure and the holding plate and deforming when the lower inner surface of the hollow rail structure is sustained by the sustaining element so as to press the holding plate tightly against the sheet material.

More preferably, the elastic member is a compression spring.

In another aspect, the present invention relates to a holding device for use in a sheet-processing apparatus having a bed resting thereon a sheet material to be held. The holding device comprises a supporter structure secured onto the bed; a hollow rod with two ends supported by the supporter structure to be spaced from the bed; a holding plate coupled to the hollow rod for pressing against the sheet material to be held on the bed; a sustaining element disposed in the hollow rod for lifting up the holding plate to release the sheet material in response to a first operation working thereon, and pushing down the holding plate to depress the sheet material in response to a second operation working thereon; and a handle pivotally coupled to the supporter structure and securely connected to the sustaining element, the handle being pivoted to change the orientation of the sustaining element in the hollow rod so as to conduct the first and second operations.

Preferably, the sustaining element sustains against an upper inner surface of the hollow rod in response to the first operation of the handle, and sustains against a lower inner surface of the hollow rod in response to the second operation of the handle.

Preferably, the hollow rod has a through hole penetrating through two opposite end surfaces thereof, and the sustaining element penetrates the through hole.

Preferably, the eccentric cam has a circle circumference with a flat edge, and the flat edge and the shaft are disposed at opposite sides of the center of the eccentric cam.

According to a further aspect of the present invention, a holding device for use in a sheet-processing apparatus having a bed resting thereon a sheet material to be held comprises a hollow rail structure disposed above and spaced from the bed; a holding plate coupled to the hollow rail structure for pressing against the sheet material resting on the bed so as to facilitate the operation of the sheet-processing apparatus; and a sustaining element disposed inside the hollow rail structure for sustaining against a first inner surface of the hollow rail structure so as to lift up the holding plate to release the sheet material or sustaining against a second inner surface of the hollow rail structure so as to push down the holding plate to press the sheet material against the bed.

Preferably, the holding device further comprises a supporter structure secured onto the bed for supporting the hollow rail structure to be spaced from the bed.

Preferably, the holding device further comprises a handle pivotally coupled to the supporter structure and securely connected to the sustaining element, wherein the handle is pivoted in a first direction to have the sustaining element sustain against the first inner surface of the hollow rail structure, and pivoted in a second direction to have the sustaining element sustain against the second inner surface of the hollow rail structure.

Preferably, the sustaining element includes an eccentric cam having a flat edge for sustaining against the wall of the hollow rail structure.

Preferably, the holding device further comprises a screw element for coupling the holding plate to the hollow rail structure, wherein the screw element has an upper end secured to the bottom of the hollow rail structure by screwing and a lower end movably engaging with a shoulder portion of the holding plate. More preferably, there is a space reserved under the shoulder portion for the screw element to vertically move therein.

Preferably, the holding device further comprises a compression spring winding around the screw element and interfaces between the hollow rail structure and the hold plate for adjusting clearance between the holding plate and the bed according to the thickness of the sheet material.

BRIEF DESCRIPTION OF THE DRAWINGS

The present invention may best be understood through the following description with reference to the accompanying drawings, in which.

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1A:
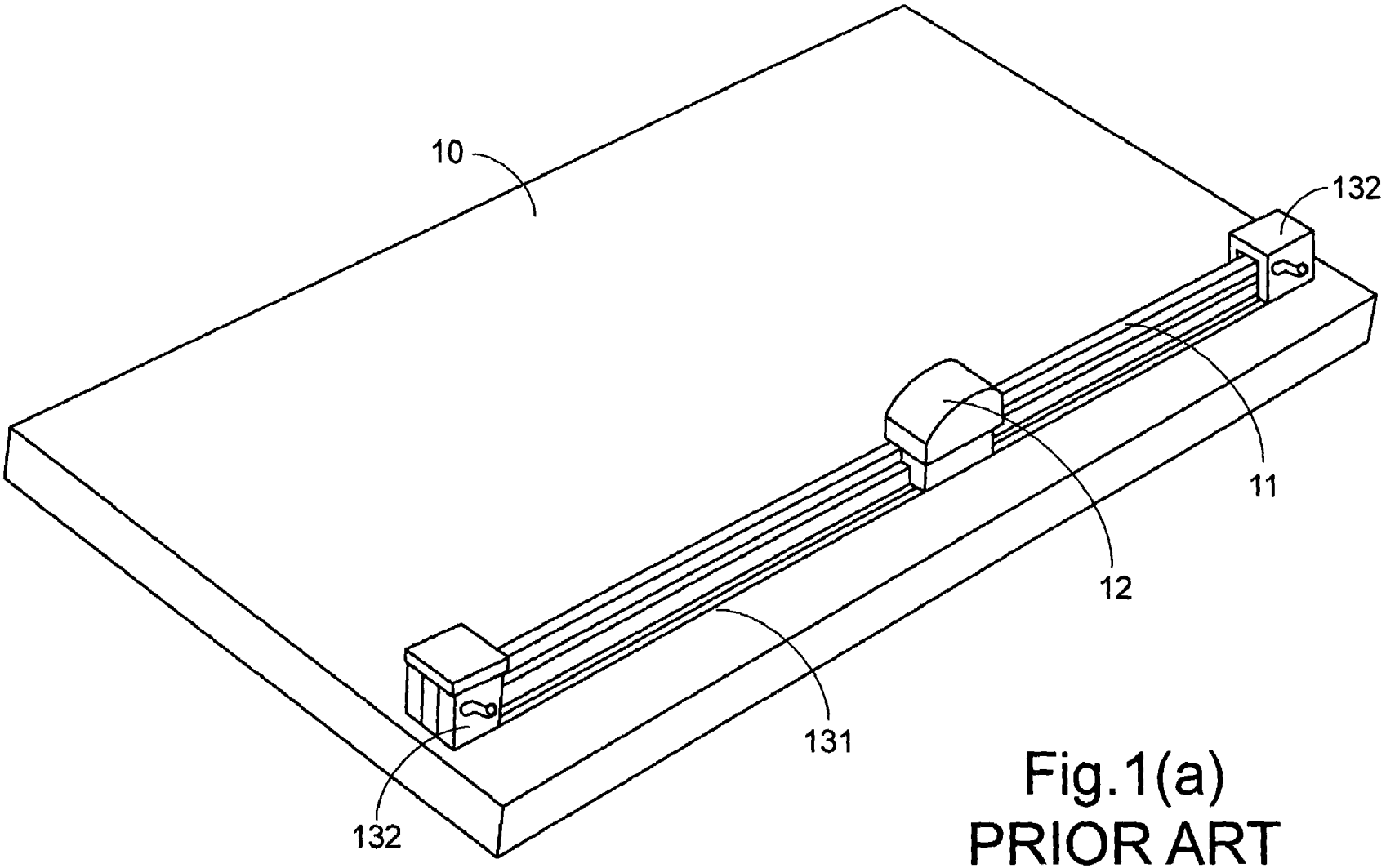
Fig.1(a) PRIOR ART
FIGS. 1(*a*) and 1(*b*) are schematic diagrams showing the appearance and inner structure of a conventional paper cutter.
Figure 1B:
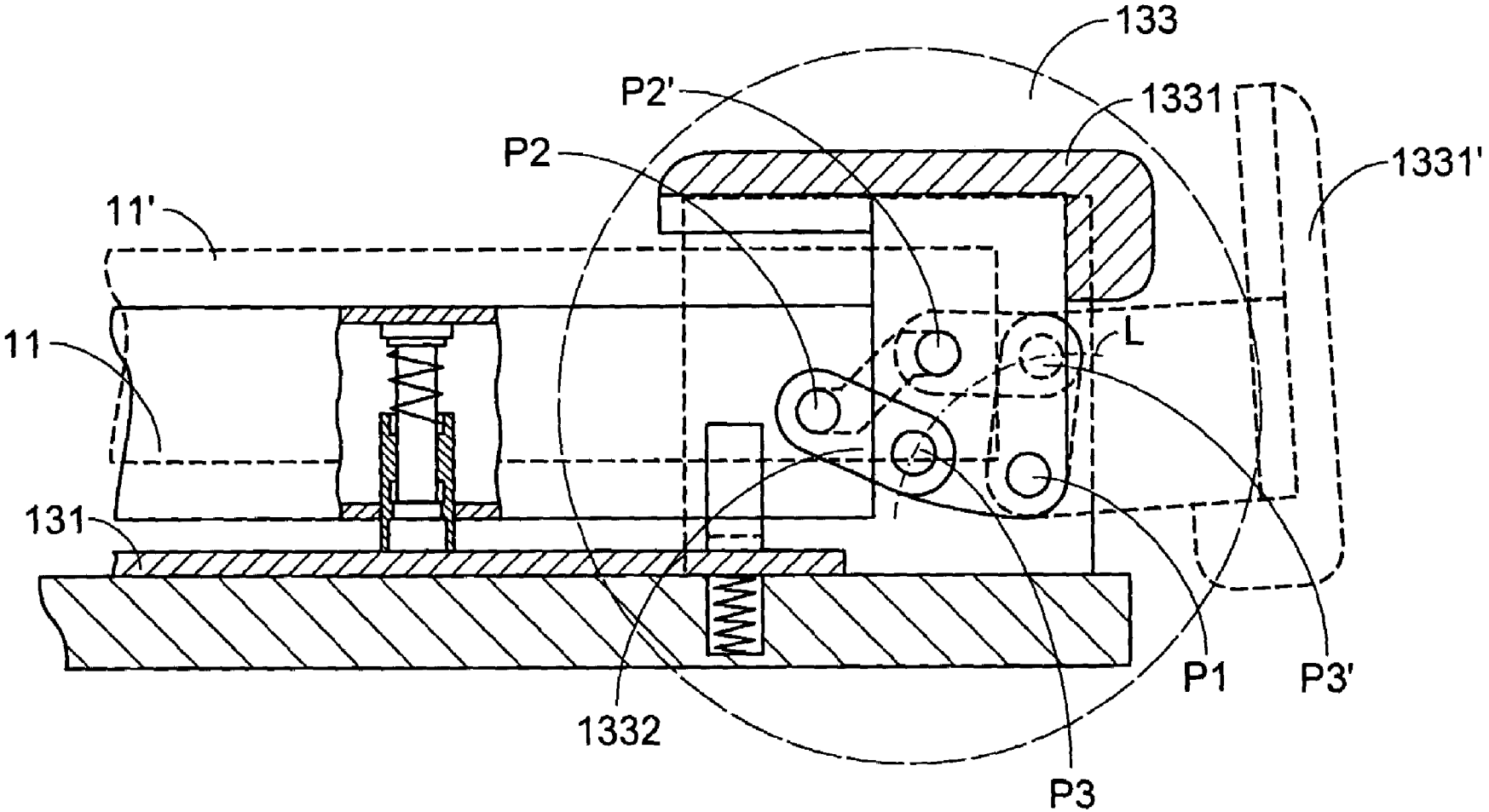
Fig.1(b) PRIOR ART
Figure 2:
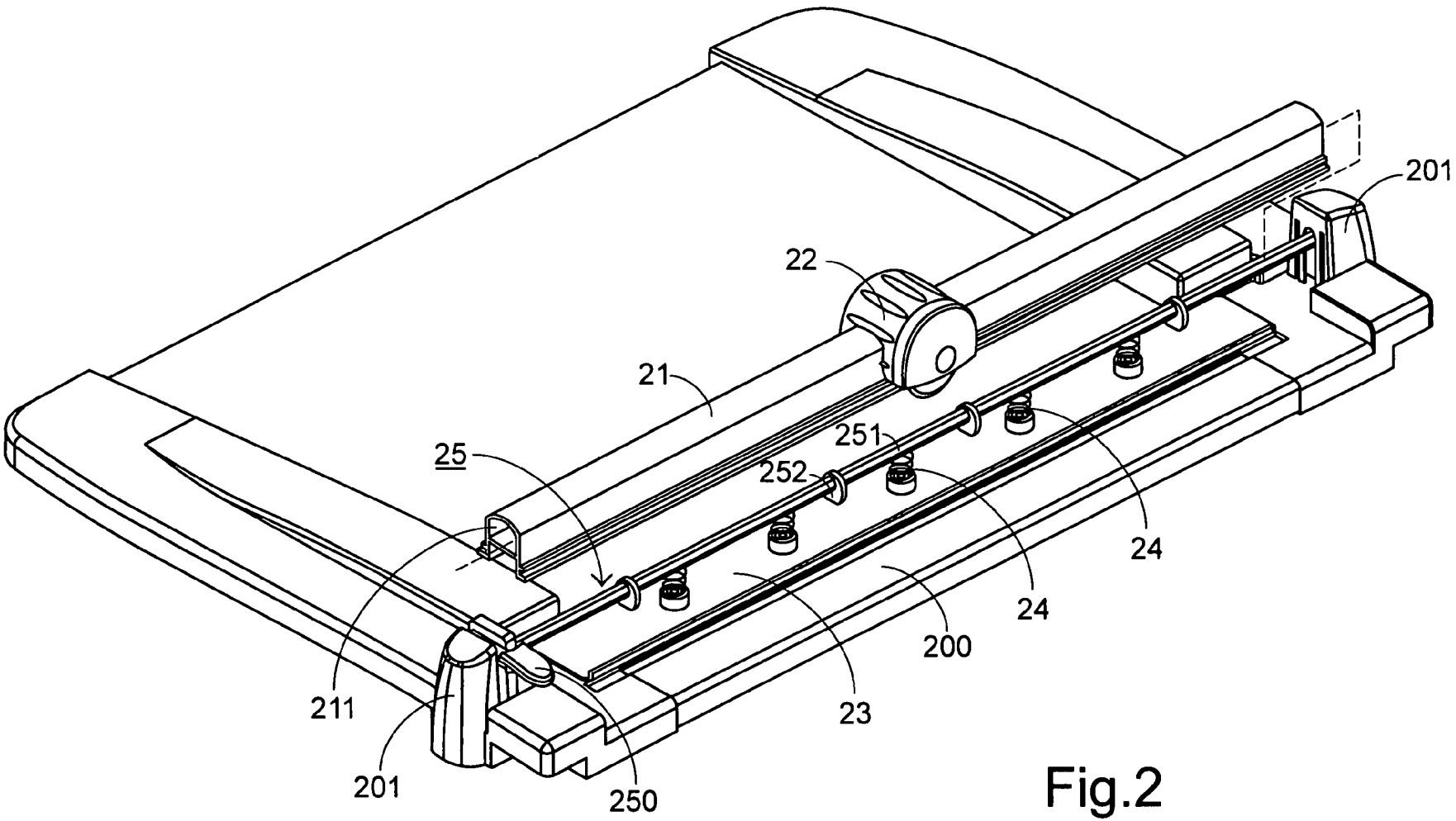
FIG. 2 is a partially resolving diagram illustrating the components of a holding device used in a paper cutter according to a preferred embodiment of the present invention.

Please refer to FIG. 2 which is a schematic diagram illustrating a cutting apparatus according to an embodiment of the present invention. In order to clearly illustrate the holding device of the cutting apparatus, the hollow rod 21 is resolved from the assembly structure in this figure. In fact, in this embodiment, the hollow rod is combined to the assembly by penetrating therethrough the sustaining element 25. In addition to the hollow rod 21 serving as the rail structure for traveling the cutting element 22 therealong and the sustaining element 25, the holding device further includes a pair of supporters 201, a holding plate 23, a plurality of compression springs 24 and a handle 250, also referring to FIGS. 3(*a*)~3(*c*). The supporters 201 are disposed at opposite ends of the bed 200 for the sustaining element 25 and thus the supporting the hollow rod 21 sleeving on the sustaining element. The holding plate 23 is coupled to the hollow rod 21 via a screw element 26 that has an upper end secured to the bottom of the hollow rod 21 by screwing and a lower end movably engaging with a shoulder portion 231 of the holding plate 23. There is a space 27 reserved under the shoulder portion 231 for the screw element 26 to vertically move therein. Each compression spring 24 winds around one screw element 26 and interfaces between the hollow rod 25 and the holding plate 23. The sustaining element 25 includes a shaft 251 penetrating through one or more cam portions 252 at non-center positions so as to form eccentric cam(s), and the assembled sustaining element 25 then penetrates through the through hole 211 of the hollow rod 21. The handle 250 is pivotally coupled to one of the supporters 201 and secured to the shaft 251 so that the shaft 251 can rotate with the handle 250. The other end of the shaft 251 is coupled to another supporter 201 without the handle 250 adjacent thereto.

Figure 3A:
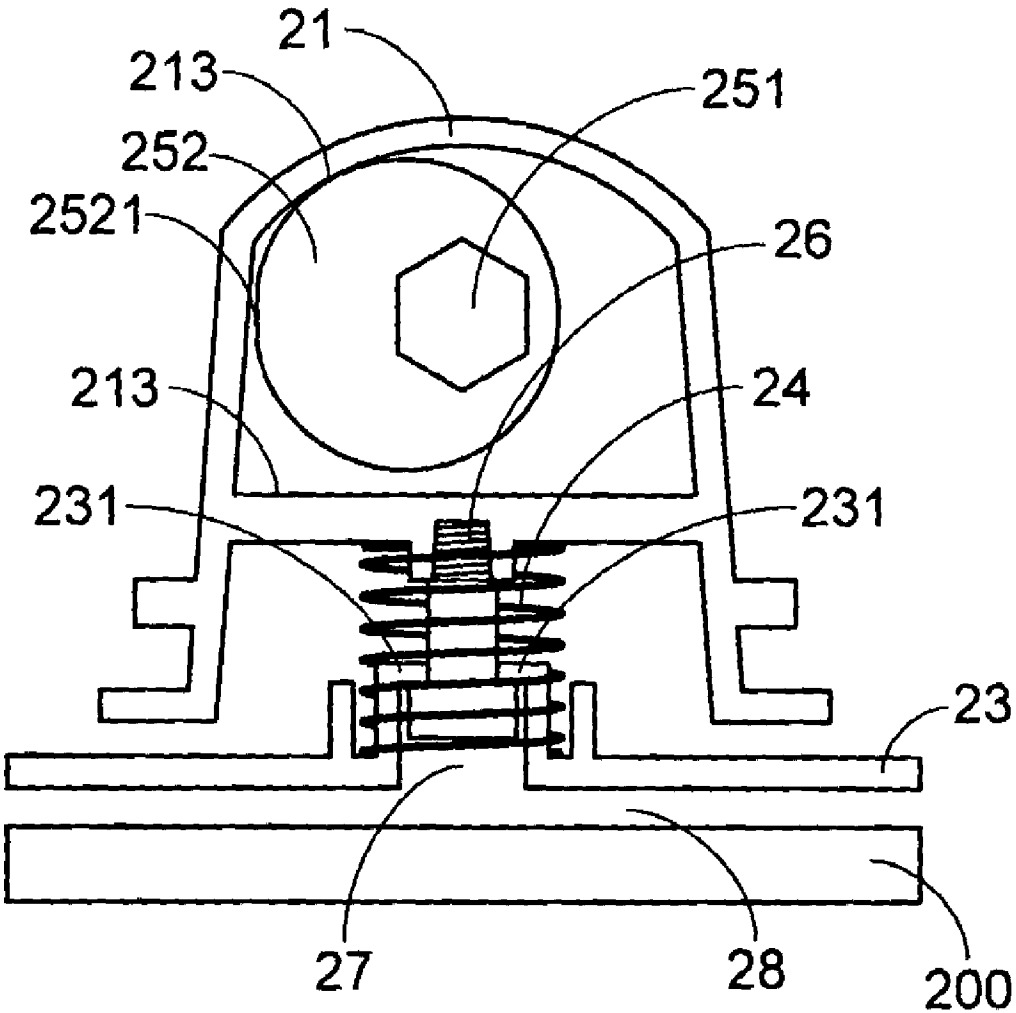
FIGS. 3(*a*)~3(*c*) are side cross-sectional views illustrating the relative positions of the components of the holding device of FIG. 2 in different operational states.
Figure 3B:
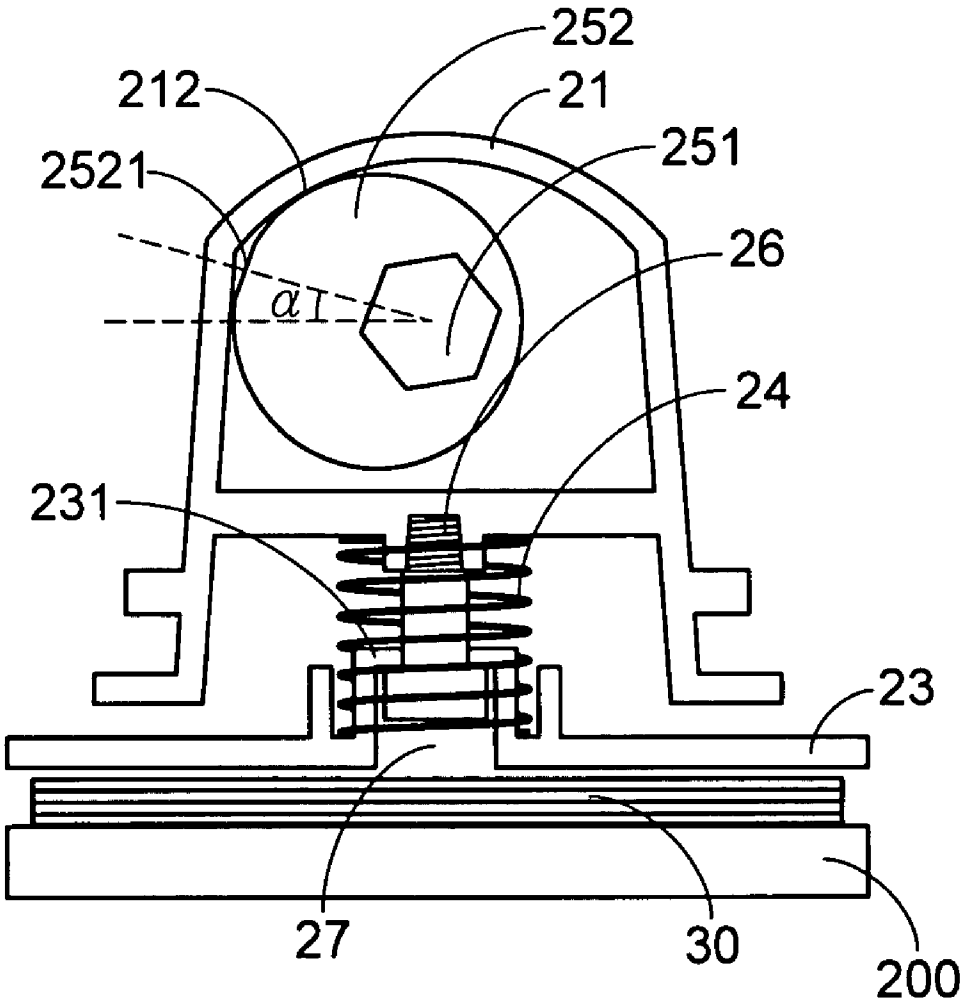
Figure 3C:
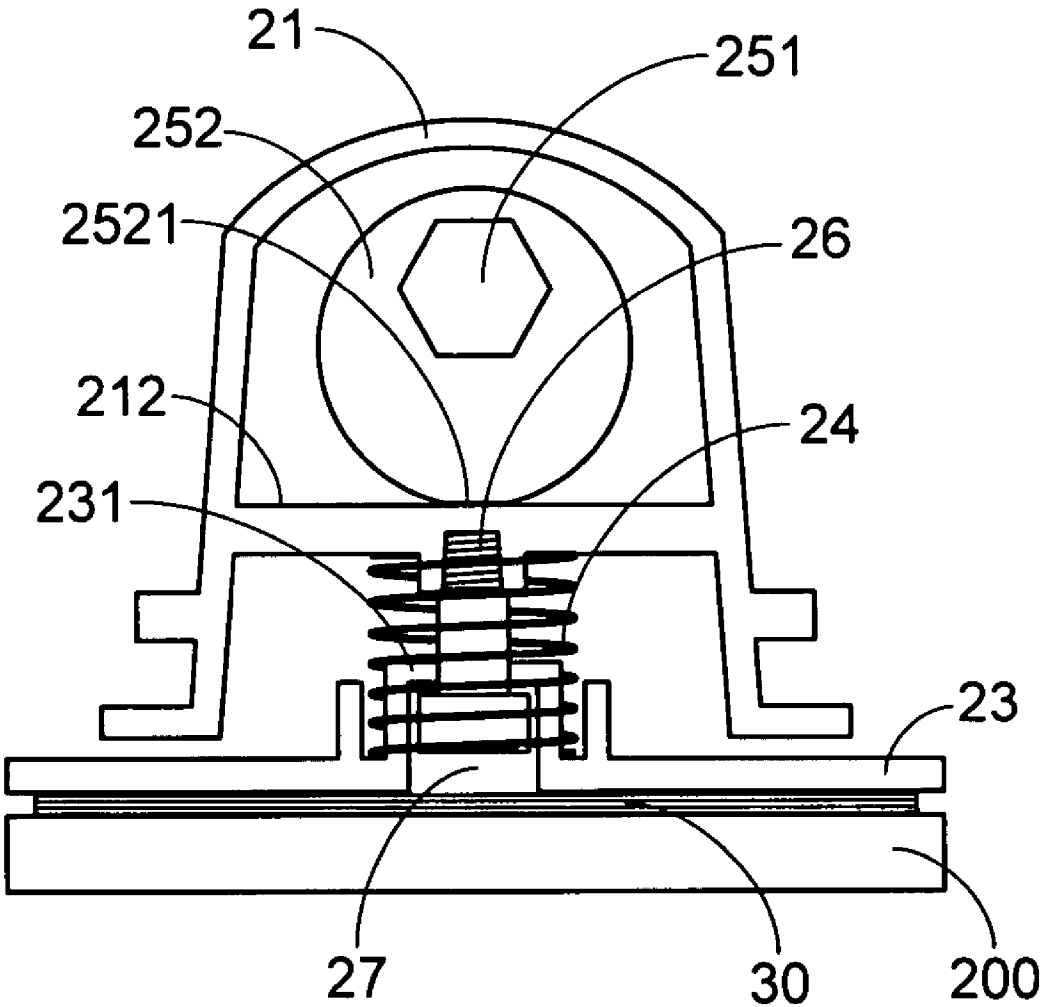

Referring now to FIGS. 3(*a*)~3(*c*), which show the holding plate 23 at a standby position, an object-releasing position and an object-securing position, respectively. When there is no cutting operation to be performed, the holding plate 23 is preferably moved to the standby position as shown in FIG. 3(*a*). Meanwhile, the compression spring 24 is kept at a relax state, i.e. no external force is exerted thereon, so as to elongate the life span of the compression spring 24.

When an object, e.g. a stack of paper 30, is to be put between the holding plate 23 and the bed 200 to be cut, it is necessary to lift up the holding plate 23 to enlarge the gap 28 for receiving the paper 30. As shown in FIG. 3(*b*), the user turns the handle 250 upward to rotate the shaft 251 clockwise from the standby position shown in FIG. 3(*a*) toward the object-releasing position. The eccentric cam 252 thus rotate with the shaft 251 up to a maximum angle α. The clearance between the holding plate 23 and the bed 200 correlates to the rotating angle α of the cam 252, which varies with the position of the shaft 251 inside the cam 252. Therefore, the shaft 251 should be properly positioned in the cam 252 so as to have an appropriate clearance between the holding plate 23 and the bed 200, thereby permitting suitable amount of paper to be cut per run. The amount of paper to be cut per run depends on the cutting capacity of the cutter, e.g. the cutting ability of the blade. For a common paper cutter, the angle α is set about 20 degrees. Alternatively, the clearance between the holding plate 23 and the bed 200 can be adjusted for example by varying the size of the eccentric cam 252 and the rotating range of the handle 250. After the shaft 251 rotates with the handle 250 to have the cam 252 rotate by the angle α, the cam 252 is moved up to sustain against the upper inner surface 212 of the hollow rod 21 and urges the hollow rod 21 to move upwards. The holding plate 23 coupled to the hollow rod 21 via the screw element 26 is also lifted up by hooking the lower end of the screw element 26 with the shoulder portion 231 thereof. Hence, the gap 28 (FIG. 3(*a*)) is enlarged to permit proper amount of paper 30 to be inserted in. Meanwhile, the compression spring 24 is still in the relax state.

After the paper 30 to be cut is well mounted, the user turns down the handle 250. As shown in FIG. 3(*c*), the shaft 251 rotates counterclockwise so as to drive the eccentric cam 252 to sustain against the lower inner surface 213 of the hollow rod 21 to urge the hollow rod 21 to move downwards. Hence, the holding plate 23 coupled to the hollow rod 21 is pushed down to depress the paper 30. Meanwhile, the screw element 26 moves down in the space 27, and the compression spring 24 interfacing between the hollow rod 21 and the holding plate 23 deforms accordingly to further hold the paper 30 tight. The compression force of the spring 24 depends on the thickness of the paper 30 positioned thereunder. After the paper 30 is settled and held, the user forces the cutting element 22 to slide along the rail structure 21 so that the blade under the cutting element 22 passes cross and cut the paper 30.

In this embodiment, the shaft 251 has a hexagonal circumference, and the cam 252 has a circle circumference. The shaft 251, alternatively, can be of any other suitable shape such as polygon. On the other hand, at least one flat edge 2521 is preferably provided on the circumference of the eccentric cam 252 to stabilize the sustaining operation of the cam 252 against the inner surface of the hollow rod 21. More preferably, the flat edge 2521 is exactly rotated to sustain the lower inner surface 213 of the hollow rod 21 when the shaft 251 rotates to move the holding plate 23 to the object-holding position. The holding device, although being illustrated with reference to a paper-cutting apparatus, can be applied to any other sheet-processing apparatus requiring to hold sheet material in a manner similar to the present invention.

In conclusion, the holding device according to the present invention has much simpler structure than the prior art. It is advantageous that the holding device can be easily assembled. Besides, the movement of the holding plate is in a vertical way which can effectively prevent the stack of paper from slipping so as to facilitate the accuracy cutting.

While the invention has been described in terms of what is presently considered to be the most practical and preferred embodiments, it is to be understood that the invention needs not be limited to the disclosed embodiment. On the contrary, it is intended to shield various modifications and similar arrangements included within the spirit and scope of the appended claims which are to be accorded with the broadest interpretation so as to encompass all such modifications and similar structures.

What is claimed is:

1. A cutting apparatus, comprising:

a bed for resting thereon a sheet material;

a hollow rail structure disposed above and spaced from said bed;

a cutting element moved along said hollow rail structure to travel on said sheet material resting on said bed so as to cut said sheet material in a desired manner;

a holding plate coupled to said hollow rail structure for pressing against said sheet material resting on said bed so as to facilitate the cutting operation of said cutting element; and an eccentric cam having a shaft and disposed in said hollow rail structure for sustaining against a lower inner surface of said hollow rail structure so as to push down said holding plate to depress said sheet material in response to a first operation working thereon, wherein said hollow rail structure has a through hole for penetrating through two opposite end surfaces thereof, and said eccentric cam having a shaft penetrates said through hole.

2. The cutting apparatus according to claim 1 wherein said eccentric cam having a shaft further sustains against an upper inner surface of said hollow rail structure so as to lift up said holding plate to release said sheet material in response to a second operation working thereon.

3. The cutting apparatus according to claim 2 wherein said upper and lower inner surfaces are walls of said through hole.

4. The cutting apparatus according to claim 2 further comprising a supporter structure secured onto said bed and coupled to said eccentric cam having a shaft, and in a manner allowing said hollow rail structure to be spaced from said bed.

5. The cutting apparatus according to claim 4 further comprising a handle pivotally coupled to said supporter structure and securely connected to said shaft of said eccentric cam, wherein said handle is pivoted to rotate said shaft in a first direction so as to drive said eccentric cam to sustain against said upper inner surface of said hollow rail structure, and pivoted to rotate said shaft in a second direction so as to drive said eccentric cam to sustain against said lower inner surface of said hollow rail structure.

6. The cutting apparatus according to claim 1 wherein said eccentric cam has a circle circumference with a flat edge arranged at a position distant from said shaft for sustaining against said lower inner surface of said hollow rail structure in response to said first operation working on said shaft.

7. The cutting apparatus according to claim 1 wherein said shaft of said eccentric cam has a polygonal cross section.

8. The cutting apparatus according to claim 7 wherein said shaft of said eccentric cam has a hexagonal cross section.

9. The cutting apparatus according to claim 1 further comprising an elastic member interfacing between said hollow rail structure and said holding plate and deforming when said lower inner surface of said hollow rail structure is sustained by said eccentric cam having a shaft so as to press said holding plate tightly against said sheet material.

10. The cutting apparatus according to claim 9 wherein said elastic member is a compression spring.

11. A holding device for use in a sheet-processing apparatus having a bed resting thereon a sheet material to be held, comprising:

a supporter structure secured onto said bed;

a hollow rod with two ends supported by said supporter structure to be spaced from said bed;

a holding plate coupled to said hollow rod for pressing against said sheet material to be held on said bed;

an eccentric cam having a shaft and disposed in said hollow rod for lifting up said holding plate to release said sheet material in response to a first operation working thereon, and pushing down said holding plate to depress said sheet material in response to a second operation working thereon; and a handle pivotally coupled to said supporter structure and securely connected to said shaft of said eccentric cam, said handle being pivoted to change the orientation of said eccentric cam having a shaft in said hollow rod so as to conduct said first and second operations, wherein said hollow rod has a through hole penetrating through two opposite end surfaces thereof, and said eccentric cam having a shaft penetrates said through hole.

12. The holding device according to claim 11 wherein said eccentric cam having a shaft sustains against an upper inner surface of said hollow rod in response to said first operation of said handle, and sustains against a lower inner surface of said hollow rod in response to said second operation of said handle.

13. The holding device according to claim 11 wherein said eccentric cam having a shaft is coupled to said supporter structure and has a circle circumference with a flat edge, and said flat edge and said shaft are disposed at opposite sides of the center of said eccentric cam.

14. The holding device according to claim 11 further comprising an elastic member interfacing between said hollow rod and said holding plate and deforming when said eccentric cam having a shaft pushes said holding plate down for adjusting clearance between said holding plate and said bed according to the thickness of said sheet material.

15. The holding device according to claim 14 wherein said elastic member is a compression spring.

16. A holding device for use in a sheet-processing apparatus having a bed resting thereon a sheet material to be held, comprising:

a hollow rail structure disposed above and spaced from said bed;

a holding plate coupled to said hollow rail structure for pressing against said sheet material resting on said bed so as to facilitate the operation of the sheet-processing apparatus; and an eccentric cam having a shaft and disposed inside said hollow rail structure for sustaining against a first inner surface of said hollow rail structure so as to lift up said holding plate to release said sheet material or sustaining against a second inner surface of said hollow rail structure so as to push down said holding plate to press said sheet material against said bed, wherein said hollow rail structure has a through hole penetrating through two opposite end surfaces thereof, and said eccentric cam having a shaft penetrates said through hole.

17. The holding device according to claim 16 comprising a supporter structure secured onto said bed for supporting said hollow rail structure to be spaced from said bed.

18. The holding device according to claim 17 further comprising a handle pivotally coupled to said supporter structure and securely connected to said shaft of said eccentric cam, wherein said handle is pivoted in a first direction to have said eccentric cam having a shaft sustain against said first inner surface of said hollow rail structure, and pivoted in a second direction to have said eccentric cam having a shaft sustain against said second inner surface of said hollow rail structure.

19. The holding device according to claim 18 wherein said eccentric cam having a shaft has a flat edge for sustaining against the wall of said hollow rail structure.

20. The holding device according to claim 16 further comprising a screw element for coupling said holding plate to said hollow rail structure, wherein said screw element has an upper end secured to the bottom of said hollow rail structure by screwing and a lower end movably engaging with a shoulder portion of said holding plate.

21. The holding device according to claim 20 wherein there is a space reserved under said shoulder portion for said screw element to vertically move therein.

22. The holding device according to claim 20 further comprising a compression spring winding around said screw element and interfaces between said hollow rail structure and said holding plate for adjusting clearance between said holding plate and said bed according to the thickness of said sheet material.

* * * * *